United States Patent [19]

Bonanno

[11] Patent Number: 4,730,530

[45] Date of Patent: Mar. 15, 1988

[54] GUITAR CONTROLLER PICKUP AND METHOD FOR GENERATING TRIGGER SIGNALS FOR A GUITAR CONTROLLED SYNTHESIZER

[75] Inventor: Carmine Bonanno, Mamaroneck, N.Y.

[73] Assignee: CFJ Systems, Inc., Mamaroneck, N.Y.

[21] Appl. No.: 834,807

[22] Filed: Feb. 28, 1986

[51] Int. Cl.[4] ..... G10H 3/18

[52] U.S. Cl. ..... 84/1.16; 84/1.18

[58] Field of Search ..... 84/1.14, 1.15, 1.16, 84/1.18

[56] References Cited

U.S. PATENT DOCUMENTS 4,263,520 4/1981 Kajihata et al. ..... 84/1.16 X 4,357,852 11/1982 Suenaga ..... 84/1.16

*Primary Examiner*—Stanley J. Witkowski

*Attorney, Agent, or Firm*—Karl F. Ross; Herbert Dubno

[57] ABSTRACT

A synthesizer guitar controller pickup and method for generating control signals for a synthesizer. The control signals are NOTE, GATE, and VELOCITY. NOTE corresponds to the pitch, GATE corresponds to when the sound is initiated and stopped and VELOCITY is a signal which is proportional to the force applied to the guitar string. A DC sensor, such as a photo detector or Hall Effect transducer, is employed to detect these signals. The DC sensor measures how far the string deviates from its rest position, this value is the VELOCITY signal. The flyback from the peak deflection initiates the GATE signal to turn on the sound. When the string stops vibrating, the GATE, and thus the sound, is turned off.

30 Claims, 33 Drawing Figures

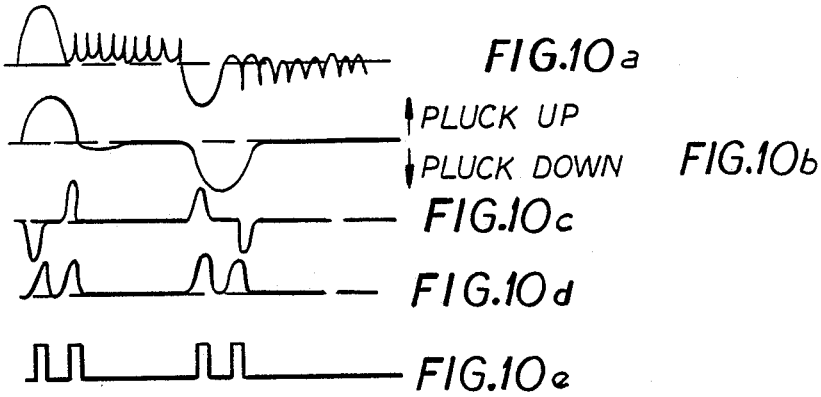
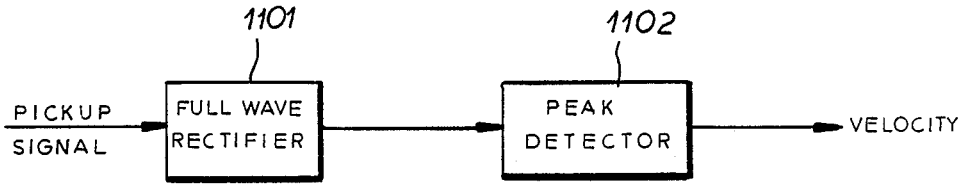
FIG.11
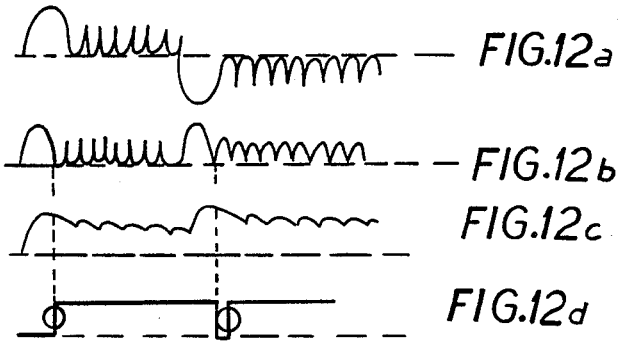

GUITAR CONTROLLER PICKUP AND METHOD FOR GENERATING TRIGGER SIGNALS FOR A GUITAR CONTROLLED SYNTHESIZER

CROSS REFERENCE TO RELATED APPLICATION

This application is related to my copending application Ser. No. 669,666 filed Nov. 8, 1984 now U.S. Pat. No. 4,630,520.

FIELD OF THE INVENTION

My present invention relates to a guitar controller pickup for an electronic music synthesizer and more particularly a device which can detect gate, velocity and trigger signals for control of the synthesizer. The invention also relates to a method for generating the aforementioned signals for a synthesizer guitar controller.

BACKGROUND OF THE INVENTION

When a keyboard is used to control a synthesizer, it provides three major control signals: NOTE, GATE and VELOCITY. The NOTE signal correspoonds to the key depressed and determines the pitch of the final sound. The GATE decides when the sound is initiated and stopped, which corresponds to the instant of key depression (for initiating the sound) and the instant key release (for stopping the sound). The VELOCITY is a parameter which is proportional to the force with which the key was struck. This may be interpreted by the synthesizer as the volume of the sound or can be used to control other timbral characteristics of the sound so that the dynamics are a direct function of the force of strike.

In a guitar synthesizer controller, preferably such as that which I have described in my copending patent application Ser. No. 669,666 filed Nov. 8, 1984 now U.S. Pat. No. 4,630,520, NOTE, GATE and VELOCITY signals must also be generated and must be derived from the normal guitar plating technique and made available for proper synthesizer operation.

In the case of a guitar controller NOTE information is determined by which string is depressed and the particular fret at which depression occurs. The method by which this information may be derived on the guitar controller previously disclosed is clearly outlined in that application.

The standard method of deriving GATE information on a guitar is to process the vibrating string through an envelope detector. However, I have discovered through experimentation, use of guitar controllers on the market and by reading published literature, that this method is inadequate for several reasons.

All of these earlier systems are fraught with various problems and drawbacks obviated by the present invention and some of which will be detailed below.

First, the speed with which an envelope detector responds to the onset of a plucked vibrating string depends on the fundamental frequency of that string, for example as described in Meno, U.S. Pat. No. 4,430,918. For instance, the Low E string on a guitar has a period of 12 milliseconds. This signal can theoretically be detected within one half cycle by an ideal envelope detector using full wave rectification. Thus, the fastest response possible for detection of the first vibratory peak would be 6 milliseconds (ms) on the low E string. This delay is detectable by the guitar player as a lag in response from the pick to the sound generated by the synthesizer. Admittedly, this minimum response time is less for higher pitched strings, however the problem becomes even more involved upon further examination. In addition, the lower frequencies of bass guitar strings makes this method totally unacceptable for bass guitar purposes.

The vibration characteristics of a guitar string are very complex. For instance, because of beating of non-harmonic overtones, the string vibration does not always reach its full peak of oscillation until well into its third or fourth cycle. Thus, any attempt at deriving a VELOCITY signal from a peak detector that follows and senses the peak of the envelope contour can cause a delay of 20 to 40 ms, which is totally unacceptable.

A further problem arises because GATE and VELOCITY information must be transmitted in immediate succession to conform with normal synthesizer protocols. Since the GATE is typically derived from the immediate rise of the envelope while the VELOCITY peak may be delayed by many milliseconds, it becomes obvious that either the GATE must be delayed to conform with the VELOCITY or the VELOCITY information must be forfeited. Thus, the standard method of deriving VELOCITY from an envelope is actually impossible.

Lastly, the complex shape of a typical guitar string vibration causes false peaks and valleys within one cycle. Thus, a fast envelope detector can actually be "fooled" into thinking that it has reached a peak of vibration when it has actually only captured a contour of the string vibration.

OBJECTS OF THE INVENTION

It is, therefore, the principal object of the present invention to provide a guitar controller pickup to derive GATE, VELOCITY, and triggering in signals for providing substantially instantaneous control signals to the synthesizer to obviate the disadvantages of the earlier systems described.

Another object is to provide an improved method of generating GATE, VELOCITY and trigger signals for a synthesizer guitar controller.

SUMMARY OF THE INVENTION

These objects and others will become apparent hereinafter are attained, in accordance with the present invention by measuring not the envelope of a vibration as described earlier but by measurement of the bend or deviation of a plucked strummed string.

According to the invention the GATE and VELOCITY sensor uses the measurement of the off-axial deviation of the guitar string, in a synthesizer guitar controller as described in my aforementioned U.S. patent application, from its at-rest, non-vibrating position at the bridge. A pickup with a DC response is necessary, so that standard magnetic pickup which rely upon the oscillation of the string in order to generate a signal are unsatisfactory.

When the string is plucked, the degree by which it is moved off axis is directly proportional to the amount of energy imparted to its pick. When the string is released after a particular deviation, the resulting amplitude of vibration will directly correlate to the degree of off-axis movement prior to the pluck.

By using a DC sensor, such as an optical or Hall effect sensor, to detect when and by how much the string is moved off axis and released, it is possible to measure how far the string deviates from its rest position. This value is used as the VELOCITY signal. The flyback from the peak deflection initiates the GATE signal to turn on the sound. When the string stops vibrating, the GATE, and thus the sound, is turned off.

BRIEF DESCRIPTION OF THE DRAWING

FIGS. 10*a*–10*e* are timing diagrams illustrating the various signals of an alternate embodiment of the gate sensor;

FIG. 11 is a block diagram of an alternate embodiment of the velocity sensor; and FIGS. 12*a*–12*d* are timing diagrams illustrating the various signals of an alternate embodiment of the velocity sensor.

SPECIFIC DESCRIPTION

The GATE and VELOCITY signals generated by the technique described are directly applicable to the guitar controller described in the aforementioned application which is hereby incorporated in its entirety by reference. The controller will use the synthesizer of that application and the note selection means of that guitar controller.

Figure 1:
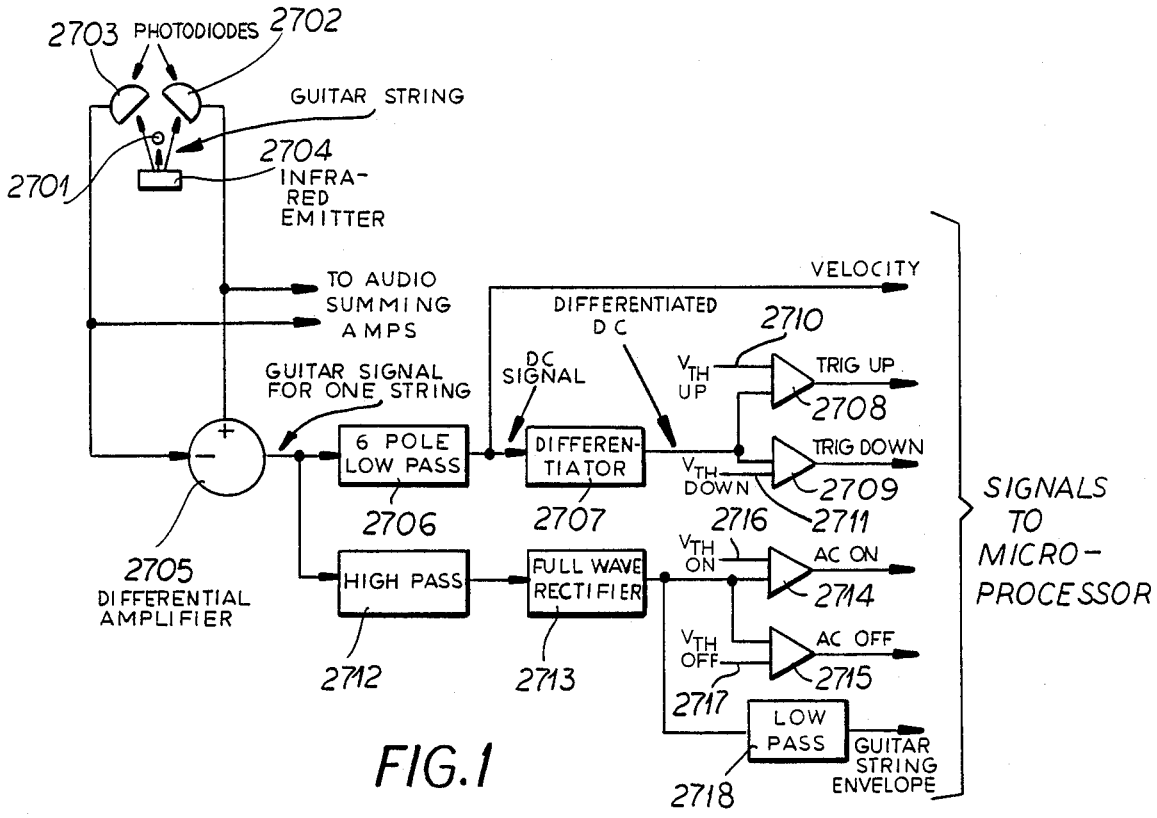
FIG. 1 is a block diagram of the gate and velocity sensor.
Figure 3:
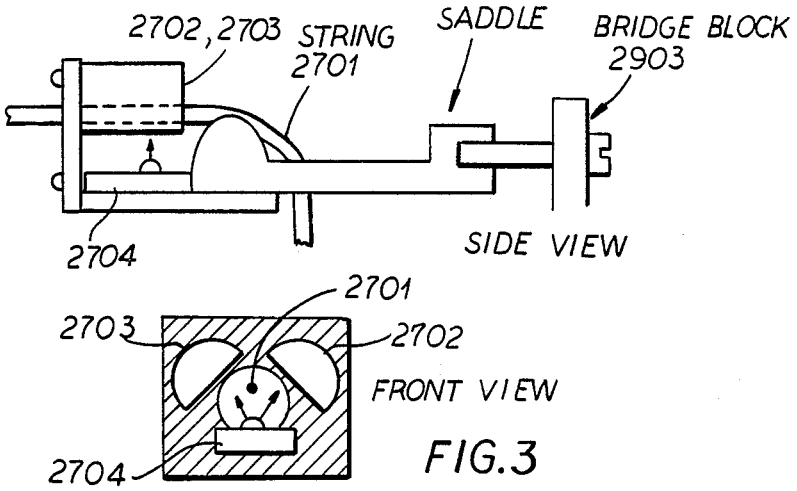
FIG. 3 is a diagrammatic section illustrating the biphase optical pickup.

FIG. 1 illustrates a preferred embodiment of the string vibration sensor. DC detaching means sense the vibration of the string 2701. Preferably two staggered reflective optical sensors 2702, 2703, (FIG. 3) from the DC detecting means and are placed near the bridge 2903 such that the string 2701 rests on the edge of the sensitive fields of each detector 2702 and 2703. This configuration allows the maximum sensitivity for sensing both AC-generating vibration and DC-signal generating movement off axis. Under the string is an infrared emitter 2704.

FIGS. 4*a*–4*e* illustrate the principles of the optical pickup. The string 2701 has a diameter d and is located a distance D from the optical emitter 2704. The string will cast a shadow of angle $\phi$ where:

$$\tan\phi = d/D$$

Typically, guitar strings range from 0.009 inches in diameter to 0.056 inches in diameter. The strings will typically be located a distance of 0.1 inches from the sensor so that angle $\phi$ ranges from:

$$\min\phi = \arctan 0.009/0.1 = 5°$$

$$\max\phi = \arctan 0.056/0.1 = 29°.$$

The placement of the sensors 2702, 2703 makes them sensitive to both vertical and horizontal string movement. As the string is moved in one direction (FIG. 4*b*) the output of optical sensor 2702 is at its maximum and the output of optical sensor 2703 is at its maximum.

When the string is in the at-rest position both sensors 2702 and 2703, have equal outputs between their minimum and maximum outputs. Conversely, as the string is deflected in the other direction the output of optical sensor 2703 is at its minimum and the output of optical sensor 2702 is at its maximum.

Figure 4A:
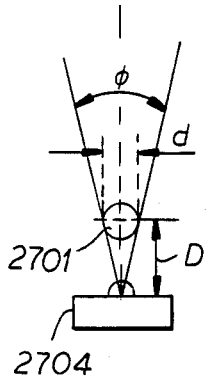
FIGS. 4*a*–4*e* are diagrams illustrating the principles of the biphase optical pickup.
Figure 4B:
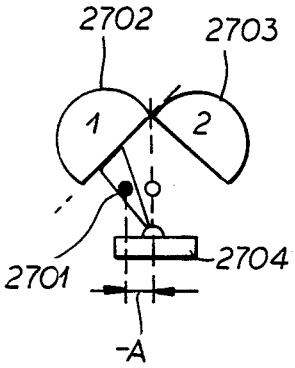
Figure 4C:
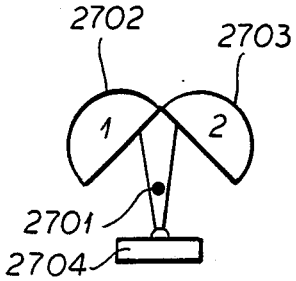
Figure 4D:
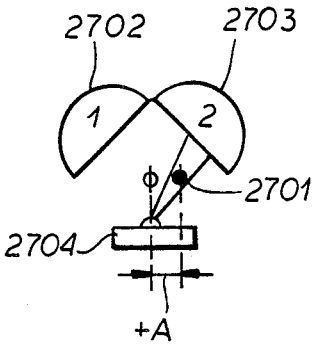
Figure 4E:
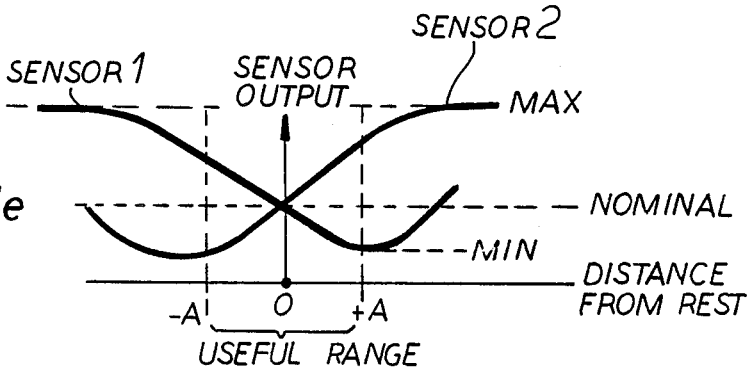

FIG. 4*e* illustrates the magnitude of sensor 2702 and sensor 2703 a function of deflected distance, referred to as sensors 1 and 2, respectively.

As the string vibrates on the horizontal axis, the sensors 2702, 2703 generate out of phase signals, each peaking as the string approaches the optical axis on either side. In addition to sensing this horizontal movement, the DC output of the sensors will also vary in accordance with string movement in the vertical direction. Horizontal movement corresponds to string plucking, bending and vibration, while vertical movement corresponds to the string being fretted and moving closer to the fret board as it is pressed.

Figure 5A:
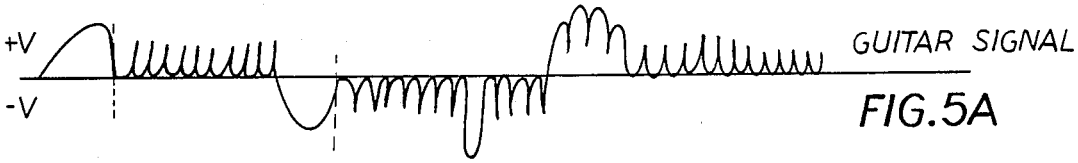
FIGS. 5A–5H are timing diagrams illustrating the various signals of the gate and velocity sensor.
Figure 5B:
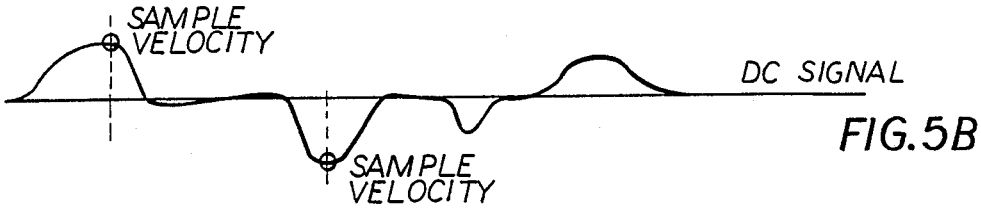

Since the vertical movement only occurs when the string is fretted, the magnitude of this signal depends upon which fret is pressed. The magnitude increases for frets nearer the bridge. Because it is a DC signal, FIG. 5B, this offset may inadvertently be interpreted as a pluck if it exceeds the processing threshold for normal plucking and so it must be minimized.

Fortunately, the outputs of the optical sensors are out of phase, so that summing their outputs in a summing means, preferably a differential amplifier 2705, cancels any common mode signals (vertical motion) while amplying differential signals (horizontal motion). Thus by summing the outputs of the optical sensors, the unwanted vertical movement is eliminated while the useful horizontal movement is enhanced.

It is necessary to turn on and turn off a gate signal in response to the string pluck. A gate is turned on when the string begins vibrating (FIG. 5A) after it flies back from being picked and turned off when the amplitude of vibration decreases to the point at which it is no longer detectable.

In examining the summed sensor outputs, the subaudio DC component of the signal corresponds to the off-axis string movement by plucking, while the AC signal corresponds to the string vibration. In order to extract the DC signal, the outputs of the sensors 2702 and 2703, are summed in a summing means, forming a guitar signal, preferably a differential amplifier 2705, whose output is passed through a lowpass filtering means, preferably a sharp low pass filter (2706), whose cutoff is below the fundamental frequency of vibration for the string being sensed. The DC signal now corresponds to the position of the string in the horizontal plane, FIG. 5B. Because of the large phase shifts in the sharp low pass filters, this signal will be lagged by several milliseconds. Since the cutoff frequencies are on the order of 40 Hz, this lag may be on the order of 10 to 20 milliseconds.

Figure 5C:
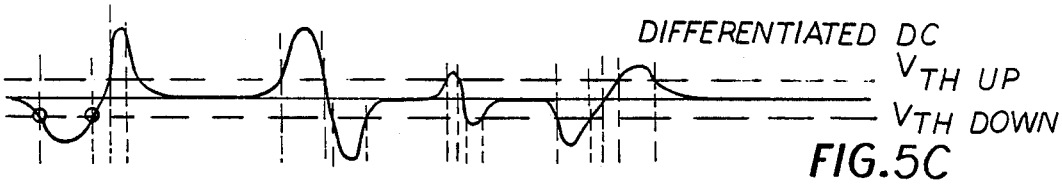

To overcome this, the signal is further processed by a differentiating means, preferably a differentiator 2702, whose output corresponds to changes in the slope of the DC signal, FIG. 5C. Thus, when the DC signal is rising, the differentiator will generate a negative peak, while falling slopes will generate a positive peak. These positive and negative peaks are used to generate trigger signals, that are then used to qualify string movements as valid gates.

Figure 5D:
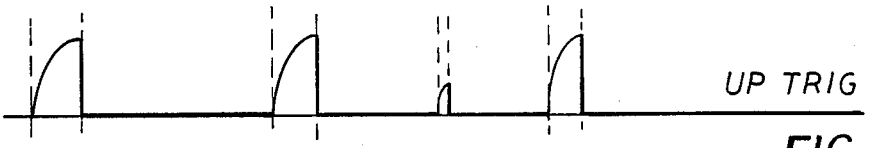
Figure 5E:
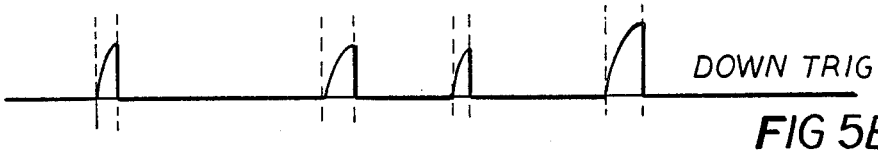

Using the differentiated DC signals, we can derive trigger pulses by passing the differentiated signal through a comparing means, preferably comparators 2708 and 2709, comparing the signal to either a trigger up reference voltage 2710 or a trigger down reference voltage 2711, FIG. 5D and 5E, that correspond to string movement in either the "up" or "down" direction, called TRIG UP and TRIG DOWN. Thus, it is now possible to use the information of "which direction was the string picked" to generate another control parameter for the synthesizer.

The availability of a trigger for either direction means that two synthesizer sounds can be generated for each string, depending upon which direction it is plucked. For instance, a down pluck may trigger a trumpet sound while an up pluck will trigger a violin sound. This is virtualy impossible with anything but a DC-based pick detection system and is a substantial enhancement to the many virtues of the guitar synthesizer controller.

These trigger pulses must be distinguished as having been caused by a pick rather the than string motion due to bending the string off of its resting position by the fretting hand. To do this, the vibration or AC information is used to qualify the trigger pulses.

Whenever a string is picked, a burst of vibration occurs because of the energy that is imparted by the pick. This eventually decays and forms the typical plucked guitar timbre. This initial burst of AC signal may be used to qualify the pick triggers as being valid. The signal called AC ON is used to gate the TRIG UP and TRIG DOWN pick triggers so that a GATE is initiated only if an UP or DOWN TRIG precedes a valid AC ON.

In the logic used for the system presently implemented, the AC ON signal is valid on its falling edge. So, a GATE will only go high (its valid state) when AC ON falls after a TRIG UP or TRIG DOWN, FIG. 5H.

A more sensitive AC detector determines when the AC signal on the string has decayed to an inaudible level. This is called AC OFF and is used to turn the GATE off.

Figure 5F:
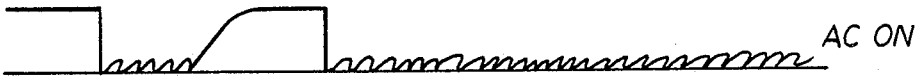
Figure 5G:
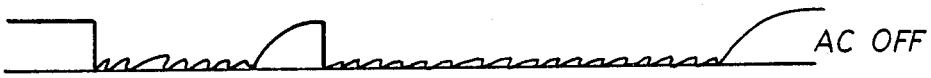
Figure 5H:
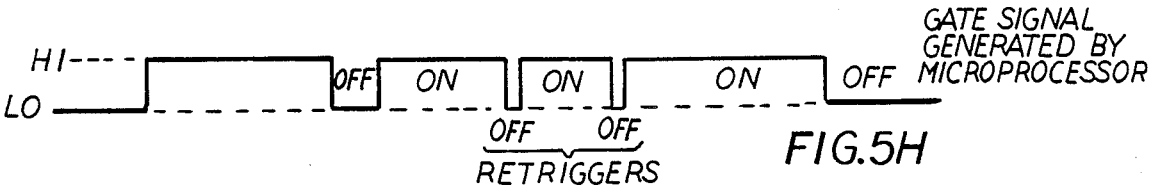

The AC ON and AC OFF signals, FIGS. 5F and 5G respectively, are derived from the output of the differential amplifier 2705, by passing the summed signal through a high pass filtering means 2713. The output of the rectifying means 2713 is connected to a comparing means, preferably a set of comparators 2714 and 2717. By comparing the signal to either a reference AC ON voltage, 2716, or reference AC OFF voltage, 2717, an AC ON or AC OFF signal is formed.

The output of rectifying means is also connected to a low pass filtering means 2718, for deriving the guitar string envelope.

While the string is vibrating, it may be plucked very quickly so that the AC ON detector remains low. This is because it cannot turn off in such a short time. The DC UP and DOWN detectors, however, can be made sensitive enough to capture the short DC pulses that occur in even the fastest picking and thus can be used to monentarily set the GATE low so as to retrigger the synthesizer sound.

This multiple retriggering is impossible with an AC based systems because many times the AC signal cannot even be visually distinguished as having been picked when viewed on a storage oscilloscope. Thus, a system that relies solely on AC variations cannot derive the retriggers that actually exist. The DC method, however, accurately extracts this information and thus makes the multiple strum possible on a guitar synthesizer controller.

VELOCITY is derived by sampling the strings' maximum DC deviation from its nominal DC value at rest. At that time, the TRIG UP or DOWN signal is used to sample the peak which is then digitized and held until the GATE ON is triggered. The synthesizer is then sent both GATE ON and VELOCITY information. The output of low pass filter 2706, forms the velocity signal.

Thus, unlike the peak detection method of deriving GATE and VELOCITY, the velocity is actually available BEFORE the gate turns on.

A problem arises when attempting to measure VELOCITY peaks while the string is bent off axis. In this case, the true value of the string movement due to picking is masked by the offset caused by the string being pushed off axis by the fretting finger. Of course, since it is impossible to bend an unfretted string, this case is not a problem when picking open strings.

In a synthesizer guitar controller, as described in my aforementioned U.S. patent application, a string bending sensor may be placed at the nut on the guitar neck. The output of this bend sensor can be used to compensate the DC sensor at the bridge so that the DC offset caused by string bending is cancelled at the bridge.

By subtracting the bend sensor output from the DC pick detector output, any string bending offsets may be nulled out at the bridge pickup. The scale factor for the null will be dependent upon the fret at which the bending occurs because the nut and bridge sensors are inversely proportional with respect to bend sensing. Thus, a scaled compensation is necessary. This can easily be accomplished by the control computer that is used to gather and interpret the data in the guitar synthesizer controller.

Figure 6:
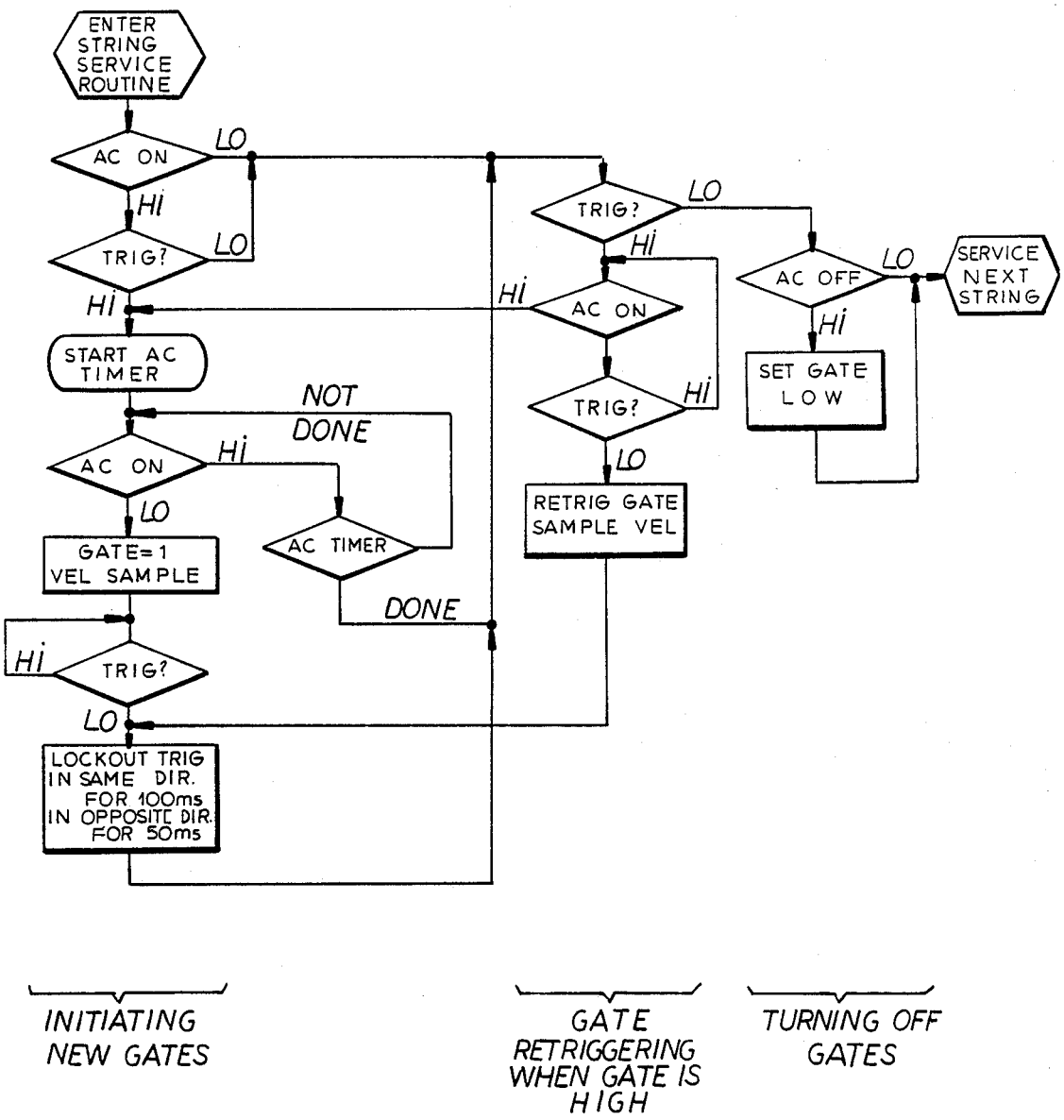
FIG. 6 is a flow chart illustrating the logic for deriving gate qualifying retriggering, velocity and string bending.

FIG. 6 is a flow chart summarizing how the gate qualifying, retriggering velocity and string bending is derived by the pickup.

Figure 2:
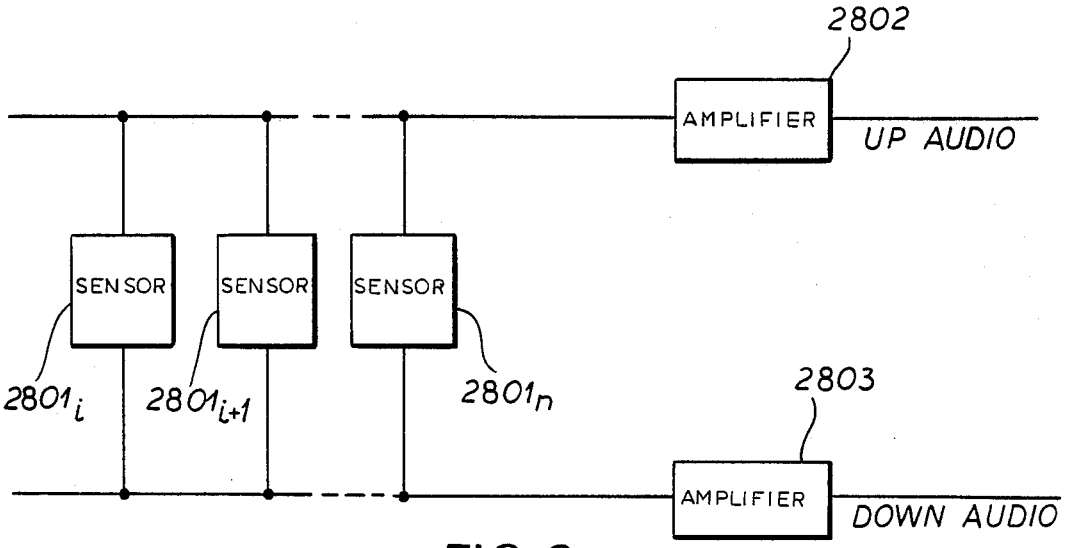
FIG. 2 is a circuit diagram of the audio summing amps.

Yet another major advantage of the bi-phase pickup is that the sensors $\mathbf{2801}_i$ (FIG. 2) will have different amplitudes and tones depending upon which direction the string is plucked. Thus, the sensors on one side may be summed and brought out independent of the summed sensors $\mathbf{2801}_i$, $\mathbf{2801}_{i+1}$, . . . $\mathbf{2801}_n$ on the other side.

If these summed outputs are brought out to independent amplifiers, 2802, 2803, the sound of a plucked string will come out of one amplifier when it is plucked "up" and the other amplifier when it is plucked "down", thus producing a stereo effect on each string. Thus, a bi-phase audio signal for each string is available for independently processing the string vibration in two picking directions. This I have not found possible to achieve in any other way and provides a unique richness to the guitar audio that is independent of its synthesizer controlling qualities.

Figure 7:
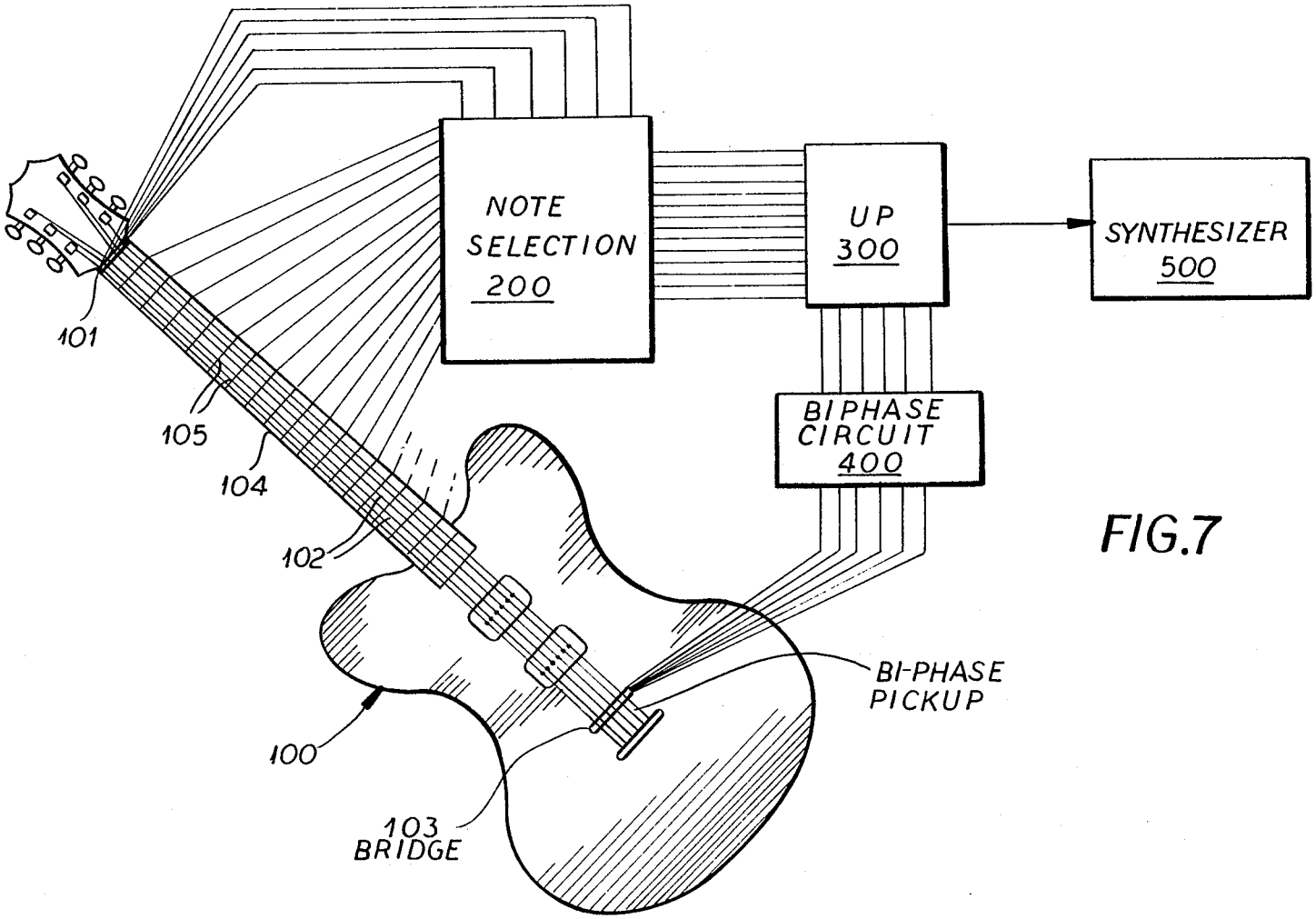
FIG. 7 is a diagram illustrating the application of the invention.

In FIG. 7, I have shown a guitar 100 having a nut 101, strings 102, a bridge 103, a neck 104 and conductive frets 105 along the neck. The note selection circuit of my prior application mentioned above is shown diagrammatically at 200 and, since it is identical in construction and operation to that of the aforementioned application it will not be described further herein except to note that the inputs to this circuit have only been shown representationally. A microprocessor unit 300, which can include a multiplexer, receives all necessary inputs from the note selection circuit 200 and the biphase circuit 400 (see FIG. 1) and outputs via a cable as described in the prior application to the synthesizer 500 which has also been described therein.

An alternate embodiment of the DC detecting means is illustrated in FIGS. 8*a*–8*d*.

FIGS. 8*a*–8*d* illustrate the principles of a monophonic optical sensor 801. An infrared emitter 803 is placed under string 802, sensor 801 is tilted so that its entire radiant sensitive area is affected by the infrared beam.

Figure 8A:
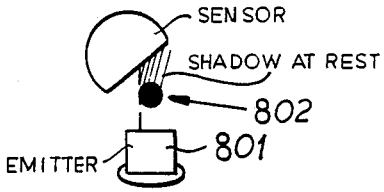
FIGS. 8*a*–8*d* are diagrammatic section illustrating the principles of the monophonic optical pickup.
Figure 8B:
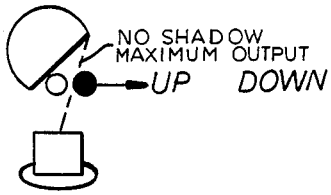
Figure 8C:
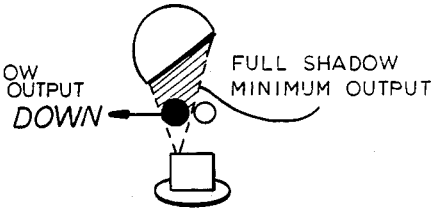
Figure 8D:
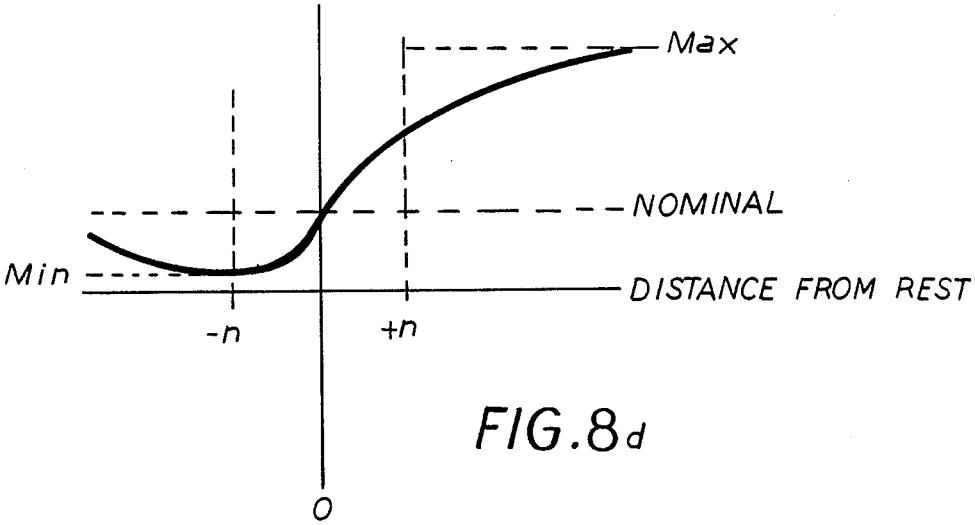

FIG. 8*a* illustrates the string 802 at an at-rest position. The output of sensor 801 has an intermediate output between its maximum output and its minimum output. When string 802 is deflected to its maximum "up" position, no shadow is cast on the sensor 801. Consequently, the sensor 801 is at its maximum output.

When string 802 is deflected to its maximum "down" position, a shadow totally eclipses the sensor. Consequently, the sensor 801 is at its minimum output. The vertical motion is cancelled out by virtue of the fact that the change in the shadow cast on the sensor 801 from the string moving further or closer to the emitter is very minimal as compared to the horizontal movement.

Figure 9:
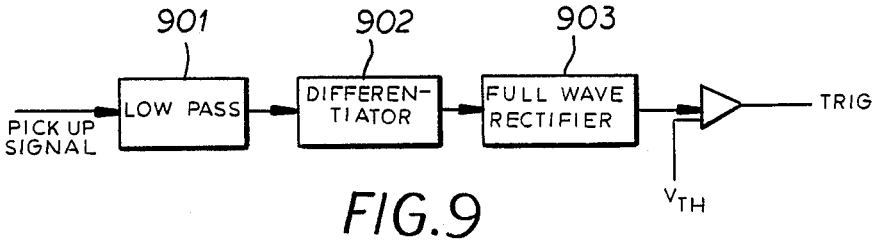
FIG. 9 is a block diagram of an alternate embodiment of gate sensor.

An alternate embodiment of the gate sensor is illustrated in FIG. 9. The output of the sensor FIG. 10*a* is passed through a low pass filter means, preferably a sharp low pass filter 901, generating a DC signal FIG. 10*b*. The DC signal, FIG. 10*b* normally rests at V1. When the string is plucked in the "up" direction, the voltage will become more positive, while if the string is plucked in the "down" direction the voltage will become more negative. By sampling the direction of the voltage deviation from the resting voltage VI whenever a gate transition is generated, it can be determined whether the picking was in the "up" or "down" direction.

The output of the low pass filter means is passed through a differentiating means 902, generating a differentiated signal FIG. 10*c*. The differentiated DC signal is further processed by a full wave rectifier 903, where output is illustrated in FIG. 10*d*. The output of the full wave rectifier is compared to a reference voltage to generate the trigger signal as illustrated in FIG. 10*e*.

An alternate embodiment of the velocity sensor is shown in FIG. 11. The output of the sensor is passed through a full wave rectifier 1101. The output of the full wave rectifier is further processed by a peak detector 1102.

FIGS. 12*a*–12*d* illustrate the output signals of the sensor, full wave rectifier and peak detector respectively. Since the output of the full wave rectifier contains the unprocessed AC and DC components of the string movement, peak detection of this will allow the control computer to sample whenever a gate transition occurs and obtain a valid velocity level, just as in the DC sample mode.

I claim:

1. In a guitar controller for a synthesizer which is connected to the synthesizer and has a plurality of strings, and fret and string responsive note generating means connected to the synthesizer, a respective guitar controller pickup device for each of said strings comprising:

DC detecting means juxtaposed with a respective string for generating a signal in response to movement of said string due to a force applied to said string upon actuation of said string by a player, forming a guitar signal whereby said DC detecting means measures off-axial displacement of said string;

first low pass filtering means coupled to said DC detecing means forming a velocity signal from said guitar signal whereby said velocity signal is proportional to said force;

differentiating means, coupled to said first low pass filtering means, for differentiating said velocity signal forming a differentiated DC signal; and gate detecting means coupled to said differentiating means for generating trigger signals said trigger signals indicating direction of movement of said string to said synthesizer.

2. A device as defined in claim 1 wherein said DC detecting means comprises a pair of detectors, a first of said pair for detecting motion in one direction and second of said pair for detecting motion in an opposite direction of said string and summing means coupled to the output of said pair of detectors.

3. A device as defined in claim 1 wherein said DC detecing means comprises a monophonic pickup for detecting motion in both directions.

4. A device as defined in claim 1 wherein said gate detecting means comprises:

a source of a reference trigger-up voltage;

a source of a reference trigger-down voltage; and a first comparing means coupled to output of said differentiating means, said reference trigger-up voltage and said reference trigger-down voltage, whereby if said differentiated DC signal exceeds said reference trigger-up voltage, trigger-up signals are generated and when said differentiated DC signal is less than said reference trigger-down voltage, trigger-down signals are generated whereby said trigger-up signal indicating upward movement of said string and said trigger-down signal indicating downward movement of said string to said synthesizer.

5. A device as defined in claim 1 wherein said gate detecting means comprises:

a full wave rectifier coupled to said differentiating means forming a full wave output;

a source of a reference trigger voltage; and a second comparing means coupled to output of said full wave rectifier and said reference trigger voltage, whereby if said full wave output exceeds said reference trigger voltage, said trigger signals are generated.

6. A device as defined in claim 1, further comprising:

high pass filtering means coupled to said output of said detecting means;

rectifier means coupled to output of said high pass filtering means forming an AC signal;

a source of a reference AC-on voltage;

a source of a reference AC-off voltage; and a third comparing means coupled to output of said rectifier means, said reference AC on voltage, and said reference AC-off voltage, whereby if said AC signal exceeds said reference AC-on voltage an AC ON signal is generated for gating said trigger signals and when said AC signal is less than said reference AC-off voltage an AC OFF signal is generated for gating said trigger signals.

7. A device as defined in claim 6, further comprising:
a second low pass filtering means coupled to output of said rectifying means forming a guitar string envelope signal.

8. A device as defined in claim 2, further comprising:
a first summing amplifier coupled to respective outputs of said first of said pair of said detectors for each of said plurality of guitar strings for summing said outputs of said first pairs forming an up audio signal whereby said up audio signal representing sound of said string when said string movement is upward; and
a second summing amplifier coupled to respective outputs of said second of said pairs of said detecting means for each of said plurality of guitar strings for summing said outputs of said second pairs, forming a down audio signal whereby said up audio signal representing sound of said string when said string movement is downward.

9. A device as defined in claim 2 wherein said detecting means are optical sensors.

10. A device as defined in claim 2 wherein said detecting means are Hall Effect sensors.

11. A device as defined in claim 3 wherein said monophonic pickup is an optical sensor.

12. A device as defined in claim 3 wherein said monophonic pickup is a Hall effect sensor.

13. A device as defined in claim 1, further comprising a bend sensor coupled the output of said DC detecting means for compensating for string movement perpendicular to off-axial displacement.

14. In a synthesizer guitar controller having a plurality of strings, a method for determining velocity, and trigger signals for each of said strings comprising the steps of:
measuring off-axial displacement of each of said plurality of strings due to a force applied to each of said plurality of strings upoon actuation of said string by a player forming a guitar signal;
low pass filtering said guitar signal forming said velocity signal whereby said velocity signal is proportional to said force;
differentiating said velocity signal forming a differentiated DC signal; and
comparing said differentiated DC signal with a reference up-voltage and a reference down-voltage whereby if said differentiated DC signal exceeds said reference up-voltage a trigger-up signal is generated forming one of said trigger signals, and when said DC signal is less than said reference down-voltage a trigger-down signal is generated, forming another of said trigger signals whereby said trigger-up signal indicating upward movement of each of said plurality of strings and said trigger-down signal indicating downward movement of each of said plurality of strings to synthesizer connectible with said guitar controller.

15. A method as defined in claim 14, further comprising the steps of:
high pass filtering said guitar signal forming a filtered guitar signal;
rectifying said filtered guitar signal forming a rectified output; and
comparing said rectified output with a reference AC-on voltage and a reference AC-off voltage, forming AC -ON signal if said rectified output exceeds said reference AC-on voltage for gating on said trigger-up signal and said trigger down signal and when said rectified output is less than said reference AC off voltage forming AC OFF signal for gating off said trigger-up signal and said trigger down signal.

16. A method as defined in claim 15, further comprising the steps of:
low pass filtering said rectified output forming a guitar string envelope for input to said synthesizer guitar controller.

17. A method as defined in claim 14 wherein the step of sensing comprises:
emitting a light signal under each of said respective guitar strings;
photo-electrically detecting upward displacement for each of said respective guitar strings forming an up-signal;
photo-electrically detecting downward displacement for each of said respective guitar strings forming a down-signal; and
summing said up-signal and said down-signal forming said guitar signal.

18. A method as defined in claim 17, further comprising the steps of:
summing said down signal for each of said guitar strings forming a down-audio signal for input as an audio signal in said guitar controller whereby said down-audio signal representing sound of said plurality of strings when each of said plurality of strings is moved downward; and
summing said up signal for each of said guitar strings forming an up-audio signal for input as an audio signal in said guitar controller whereby said up-audio signal representing sound of said plurality of strings when each of said plurality of strings is moved up.

19. In a synthesizer guitar controller having a plurality of strings, a method of determining velocity, and trigger signals for each of said strings comprising the steps of:
measuring off-axial displacement of each of said plurality of strings due to a force applied to each of said plurality of strings upon actuation of said string by a player forming a guitar signal;
low pass filtering said guitar signal forming said velocity signal whereby said velocity signal is proportional to said force;
differentiating said velocity signal forming a differentiated DC signal;
full wave rectifying said differentiated DC signal forming a full wave signal; and
comparing said full wave signal with a reference trigger voltage whereby if said full wave signal exceeds said reference trigger voltage, said trigger signals indicating direction of movement of each of said plurality of strings to a synthesizer connectible to said guitar controller are generated.

20. A method as defined in claims 14 or 19 wherein the step of sensing comprises:
emitting a light signal under each of said respective guitar strings; and
photo-electrically detecting upward and downward displacement for each of said guitar strings forming said guitar signal.

21. A method as defined in claim 19, further comprising the steps of:
high pass filtering said guitar signal forming a filtered guitar signal;

rectifying said filtered guitar signal forming a rectified output; and comparing said rectified output with a reference AC-on voltage and a reference AC-off voltage, forming AC-ON signal if said rectified output exceeds said reference AC-on voltage for gating said trigger signals and when said rectified output is less than said reference AC-off voltage forming AC-OFF signal for gating said trigger signals.

22. A method as defined in claim 21, further comprising the step of:

low pass filtering said rectified output forming a guitar string envelope for input to said synthesizer guitar controller.

23. A method as defined in claim 19 wherein the step of sensing measuring off-axial displacement comprises:

emitting a light signal under each of said respective guitar strings;

photo-electrically detecting upward displacement for each of said respective guitar strings forming an up-signal;

photo-electrically detecting downward displacement for each of said respective guitar strings forming a down-signal; and summing said up-signal and said down-signal forming said guitar signal.

24. In a synthesizer guitar controller having a plurality of strings, a method for determining gate, velocity, and trigger signals for each of said strings comprising the steps of:

said velocity signal being proportional to a force applied to each of said plurality of strings upon actuation of each of said plurality of strings by a player;

respective emitting a light signal under each of said strings;

photo-electrically detecting upward displacement for each of said strings forming an up-signal;

photo-electrically detecting downward displacement for each of said strings forming a down-signal;

summing said up-signal and said down-signal to form a string-deflection signal;

low pass filtering said string-deflection signal forming said velocity signal;

differentiating said velocity signal forming differentiated DC signal;

comparing said differentiated DC signal with a reference up-voltage and a reference down-voltage, whereby if said differentiated DC signal exceeds said reference up voltage a trigger-up signal is generated forming one of said trigger signals, and when said DC signal is less than said reference down voltage trigger-down signal is generated, forming another of said trigger signals whereby said trigger-up signal indicating upward movement of each of said plurality of strings and said trigger-down signal indicating downward movement of each of said plurality of strings to a synthesizer connectible to said guitar controller;

high pass filtering said string deflection signal forming a filtered string deflection signal;

rectifying said filtered string deflection signal forming a rectified output;

comparing said rectified output with a reference AC on-voltage and a reference AC off-voltage forming AC-on signal if said rectified output exceeds said reference AC ON-voltage forming one of said gate signals for gating on said trigger-up signal and said trigger down signal, and when said rectified output is less than said reference AC-off voltage forming AC-OFF signal, forming another of said gate signals for gating off said trigger-up signal and said trigger down signal, low pass filtering said rectified output forming a guitar string envelope, for input to said synthesizer guitar controller;

summing said down signal for each of said guitar strings forming a down-audio signal for use as an audio signal in said guitar controller whereby said down-audio signal representing sound of said plurality of strings when each of said plurality of strings is moved downward; and summing said up signal for each of said guitar strings forming an up-audio signal for use as another audio signal in said guitar controller whereby said up-audio signal representing sound of said plurality of strings when each of said plurality of strings is moved up.

25. A device for generating GATE and VELOCITY signals for the control of a synthesizer, comprising:

a guitar string subject to off-axial displacement upon actuation by a player;

a detector juxtaposed with said string and responsive to said off-axial displacement of said string and generating an output representing said displacement and independent of frequency of vibration of said string but representing direction and extent of said displacement; and circuit means connected to said detector for generating substantially contemporaneously from said DC output, a GATE signal representing initiation of note generation by said string and a VELOCITY signal proportional to a force applied to said string subject to said off-axial displacement upon said activation by said player.

26. The device defined in claim 25 wherein said detector comprises a pair of optical elements having respective sensory planes and positioned so that respective sensory planes of said elements intercept said string upon off-axial displacement of said string in two mutually perpendicular directions orthogonal to the axis of the string at rest.

27. The device defined in claim 25 wherein said circuit means including a low-pass filter connected to said detector and a differentiator connected to said low-pass filter.

28. The device defined in claim 25 wherein said circuit means includes means for discriminating between deflections of said circuit means in opposite directions representing opposite directions of plucking of said string for independently controlling said synthesizer in dependence upon the plucking direction.

29. The device defined in claim 25 wherein said circuit means includes a threshold circuit generating signals trigger for a GATE-ON signal and a GATE-OFF signal for said synthesizer.

30. A device for generating a VELOCITY signal for the control of a synthesizer in response to actuation of a guitar string comprising:

a guitar string subject to off-axial displacement upon actuation by a player;

detecting means juxtaposed with said string and having an AC output upon said off-axial displacement of said string and independent of frequency of vibration of said string but representing direction;

full wave rectifier coupled to output of said detecting means; and peak detector coupled to output of said full wave rectifier forming said velocity signal.

* * * * *